US009797172B2

(12) United States Patent
Kammerbauer

(10) Patent No.: US 9,797,172 B2
(45) Date of Patent: Oct. 24, 2017

(54) EXTERIOR DOOR HANDLE ARRANGEMENT FOR MOTOR VEHICLE DOOR OF A MOTOR VEHICLE

(71) Applicant: AUDI AG, Ingolstadt (DE)

(72) Inventor: Willi Kammerbauer, Landershofen (DE)

(73) Assignee: AUDI AG, Ingolstadt (DE)

( * ) Notice: Subject to any disclaimer, the term of this patent is extended or adjusted under 35 U.S.C. 154(b) by 175 days.

(21) Appl. No.: 14/435,074

(22) PCT Filed: Oct. 12, 2013

(86) PCT No.: PCT/EP2013/003073

§ 371 (c)(1),
(2) Date: Apr. 10, 2015

(87) PCT Pub. No.: WO2014/056624

PCT Pub. Date: Apr. 17, 2014

(65) Prior Publication Data

US 2015/0225988 A1 Aug. 13, 2015

(30) Foreign Application Priority Data

Oct. 12, 2012 (DE) ..... 10 2012 020 265

(51) Int. Cl.
*E05B 3/00* (2006.01)
*E05B 1/00* (2006.01)
(Continued)

(52) U.S. Cl.
CPC ..... *E05B 85/16* (2013.01); *E05B 15/0053* (2013.01); *E05B 77/36* (2013.01); *E05B 77/42* (2013.01);
(Continued)

(58) Field of Classification Search
CPC ..... Y10S 292/73; E05B 85/10; E05B 85/14; E05B 85/16
(Continued)

(56) References Cited

U.S. PATENT DOCUMENTS 5,654,687 A * 8/1997 LaBonde ..... E05B 85/16 180/287
5,685,581 A * 11/1997 Kritzler ..... E05B 85/16 292/336.3
(Continued)

FOREIGN PATENT DOCUMENTS

CN 2329729 7/1999
CN 101131050 2/2008
(Continued)

OTHER PUBLICATIONS

Chinese Search Report dated Apr. 1, 2016 with respect to counterpart Chinese patent application 201380053546.7.
(Continued)

*Primary Examiner* — Carlos Lugo
(74) *Attorney, Agent, or Firm* — Henry M. Feiereisen LLC

(57) ABSTRACT

An exterior door handle arrangement for a motor vehicle door of a motor vehicle includes a door handle a bearing bracket, and a hinge assembly having a pivot pin and a guide groove receiving the pivot pin for the pivotable connection of the door handle to the bearing bracket, wherein for pivoting the door handle from a resting position into a swivel-out position the pivot pin located in the guide groove forms a pivot axis of the door handle. The contour surfaces of the pivot pin and the guide groove which are in operative connection and which determine the pivot movement of the door handle are designed with a fit, such that the door handle has in the swivel-out position a clearance fit which transi-
(Continued)

tions via a transitional fit into a positive fit when a pivoting movement into to a resting position is made.

9 Claims, 5 Drawing Sheets

(51) Int. Cl.

| | |
|---|---|
| ***E05B 85/16*** | (2014.01) |
| *E05B 85/10* | (2014.01) |
| *E05B 85/14* | (2014.01) |
| *E05B 77/36* | (2014.01) |
| *E05B 77/42* | (2014.01) |
| *E05B 15/00* | (2006.01) |

(52) U.S. Cl.
CPC ..... *E05B 85/10* (2013.01); *E05B 85/14* (2013.01); *Y10S 292/73* (2013.01); *Y10T 292/57* (2015.04)

(58) Field of Classification Search
USPC ..... 292/336.3
See application file for complete search history.

(56) References Cited

U.S. PATENT DOCUMENTS

| | | | | |
|---|---|---|---|---|
| 6,349,449 | B1 | 2/2002 | Kuehl | |
| 8,540,293 | B2 * | 9/2013 | Muller | E05B 85/16 292/336.3 |
| 2005/0057049 | A1 * | 3/2005 | Choi | E05B 85/16 292/336.3 |
| 2014/0265373 | A1 * | 9/2014 | Patel | E05B 79/06 292/336.3 |

FOREIGN PATENT DOCUMENTS

| | | | | |
|---|---|---|---|---|
| DE | 4415571 | A1 * | 11/1995 | E05B 79/12 |
| DE | 19726536 | | 12/1998 | |
| DE | 102014204464 | * | 9/2014 | E05B 85/16 |
| DE | 102013112164 | * | 5/2015 | E05B 81/78 |
| EP | 0646688 | | 9/1994 | |
| EP | 1031684 | | 8/2000 | |
| WO | WO2008/120067 | | 10/2008 | |

OTHER PUBLICATIONS

Translation of Chinese Search Report dated Apr. 1, 2016 with respect to counterpart Chinese patent application 201380053546.7.

* cited by examiner

EXTERIOR DOOR HANDLE ARRANGEMENT FOR MOTOR VEHICLE DOOR OF A MOTOR VEHICLE

CROSS-REFERENCES TO RELATED APPLICATIONS

This application is the U.S. National Stage of International Application No. PCT/EP2013/003073, filed Oct. 12, 2013, which designated the United States and has been published as International Publication No. WO 2014/056624 and which claims the priority of German Patent Application, Serial No. 10 2012 020 265.2, filed Oct. 12, 2012, pursuant to 35 U.S.C. 119(a)-(d).

BACKGROUND OF THE INVENTION

The invention relates to an exterior door handle arrangement for a vehicle door of a vehicle.

Such exterior door handle arrangement is disclosed, for example. in EP 0 646 688 A1 and includes a door handle, a bearing bracket and a hinge assembly having a pivot pin and a guide groove receiving this pivot pin for pivotally connecting the door handle with the bearing bracket. In this conventional door handle arrangement, the cylindrical pivot pin may be disposed at a bearing portion of the bearing bracket, so that an end-side of the bearing fork of the door handle surrounds the pivot pin which forms an axis of rotation for the door handle. In another embodiment, the cylindrical pivot pin is secured to an end-side bearing arm of the door handle and is inserted and held in a guide groove arranged on an end side of the bearing bracket, thus allowing pivoting movement of the door handle about the pivot pin which forms a rotation axis. In addition to this hinge assembly, which supports the door handle in the direction of travel of the vehicle, the door handle is connected with a drawbar at another support location opposite the direction of travel of the vehicle.

With such an exterior door handle arrangement, the hinge assembly arranged in the direction of travel of the vehicle must guide and stabilize the door handle, wherein the independent return of the door handle from the swivel-out position into the resting position must not be blocked by friction forces in the hinge assembly.

SUMMARY OF THE INVENTION

It is an object of the invention to provide an exterior door handle arrangement of the aforementioned type that holds the door handle in the resting position without play and without impeding the return due to frictional forces. Furthermore, this exterior door handle arrangement should be easy to implement, especially without resulting in a complex assembly.

This object is solved by an exterior door handle arrangement.

Such an exterior door handle arrangement for a vehicle door of a vehicle, which includes a door handle, a bearing bracket and a hinge assembly having a pivot pin and a guide groove receiving this pivot pin for pivotally connecting the door handle with the bearing bracket, wherein the pivot pin forms a pivot axis of the door handle for pivoting the door handle from a resting position into a swivel-out position in the guide groove, is characterized according to the invention is that the contour surfaces of the pivot pin and the guide groove which are operatively connected and define the pivot movement of the door handle are formed with a fit, in such a way that a clearance fit exists in the swivel-out position of the door handle, which transitions via a transitional fit into an interference fit during a pivoting movement into the resting position.

This provides a simple, in particular cost-effective solution, namely by forming the hinge assembly with an asymmetrical support, so that during the pivoting movement from the extended position of the door handle, i.e. the swivel-out position, into the resting position of the door handle, the contour surfaces that determine the support and the pivotal movement produce a clearance fit that transitions during the pivotal movement into the resting position first into a transitional fit and thereafter into an interference fit.

The interference fit in the resting position of the door handle ensures support without play. In addition, buzzing sounds when closing the car door are eliminated.

According to an advantageous embodiment of the invention, the pivot pin is formed with an elliptical cross-section, wherein its outer surface forms a contour surface that is operatively connected with parallel surfaces forming contour surfaces of the guide groove. This continuously changes the profile of the fit during the pivotal movement of the vehicle door, which results in improved vibration damping when closing the vehicle door.

According to a further development, the pivot pin is arranged for forming the clearance fit, the transitional fit, and the interference fit so that upon pivoting of the door handle from the swivel-out position into its resting position the length of the chord of the elliptical cross-sectional shape of the pivot pin increases between the contact regions of the contour surfaces. By forming the pivot pin as an elliptical cylinder, the fits can be adapted to the respective requirements, because the range of values for the chord can be set between the small value of the minor axis and large value of the major axis of the shape of the ellipse.

In another embodiment of the invention, the flat contour surfaces of the guide groove extend in the longitudinal direction of the vehicle (x-direction of the vehicle) when the door handle is in its resting position. In this case, the pivot is to be arranged so as to produce a chord length, which in conjunction with the contour surfaces of the guide groove results in an interference fit. This means that the pivot pin becomes twisted between the two contour surfaces of the guide groove by the relative rotation of the pivot pin and the guide groove.

In a particularly advantageous embodiment, the pivot may be connected to the door handle whereby the door handle can be produced in a simple and cost-effective manner.

According to another embodiment of the invention, the pivot pin is connected to the bearing bracket, wherein the door handle has at one end a bearing fork for forming the guide groove with flat contour surfaces.

According to another embodiment of the invention, the pivot pin is formed with a polygonal cross-section, wherein its outer surface forms a contour surface that is operatively connected to parallel faces forming contour surfaces of the guide groove.

In such embodiment, the pivot is arranged so that, when the door handle is pivoted from the swivel-out position to the resting position, the length of the chord of the polygonal cross-sectional shape of the pivot pin increases between the contact regions of the contour surfaces from a chord having the length for a clearance fit to a chord generating an interference press fit.

According to a further development with such a pivot pin, the pivot pin is connected to the bearing bracket and the door handle has on one end a bearing fork for forming the guide groove with the flat contour surfaces, wherein the bearing fork and the pivot pin are aligned relative to each other that the chord generating the interference fit between the contact regions of the contour surfaces is formed in the resting position, of the door handle.

Preferably, the pivot pin and the contour surfaces of the guide groove are aligned relative to each other such that in the swivel-out position of the door handle, the contour surfaces of the bearing fork extend essentially in the longitudinal direction of the vehicle, while forming the chord between the contact regions of the contour surfaces that generates the clearance fit.

BRIEF DESCRIPTION OF THE DRAWING

The invention will be described below in detail in connection with exemplary embodiments and with reference to the attached figures, which show in.

DETAILED DESCRIPTION OF PREFERRED EMBODIMENTS

Figure 1:
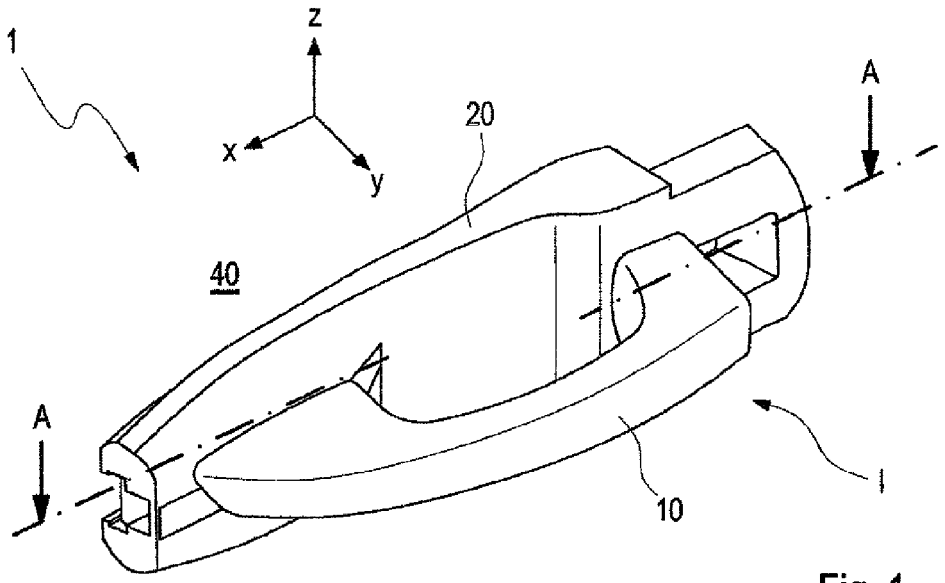
FIG. 1 a schematic perspective view of an exterior door handle arrangement according to the invention, FIG. 2 a schematic perspective sectional view of the exterior door handle arrangement along section A-A of FIG. 1, with a door handle in extended position as an exemplary embodiment of the invention, FIG. 2*a* a schematic representation of the detail B of FIG. 2, FIG. 3 a schematic sectional view of the exterior door handle arrangement according to FIG. 2 with a door handle in the resting position, FIG. 4 a schematic perspective sectional view of the exterior door handle arrangement along section A-A of FIG. 1, with a door handle in extended position as another exemplary embodiment of the invention, FIG. 4*a* a schematic representation of the detail C of FIG. 4, FIG. 5 a schematic sectional view of the exterior door handle arrangement according to FIG. 4 with a door handle in the resting position, FIG. 6 a schematic perspective sectional view of the exterior door handle arrangement along section A-A of FIG. 1, with a door handle in extended position as another exemplary embodiment of the invention, FIG. 6*a* a schematic representation of the detail D of FIG. 6, and FIG. 7 a schematic sectional view of the exterior door handle arrangement according to FIG. 6, with a door handle in the resting position.

The exterior door handle arrangement 1 shown in FIG. 1 includes a door handle 10 and a bearing bracket 20 with which the door handle 10 is pivotally connected. FIG. 1 shows the door handle 10 in a resting position I, i.e. in its stored position.

Figure 2:
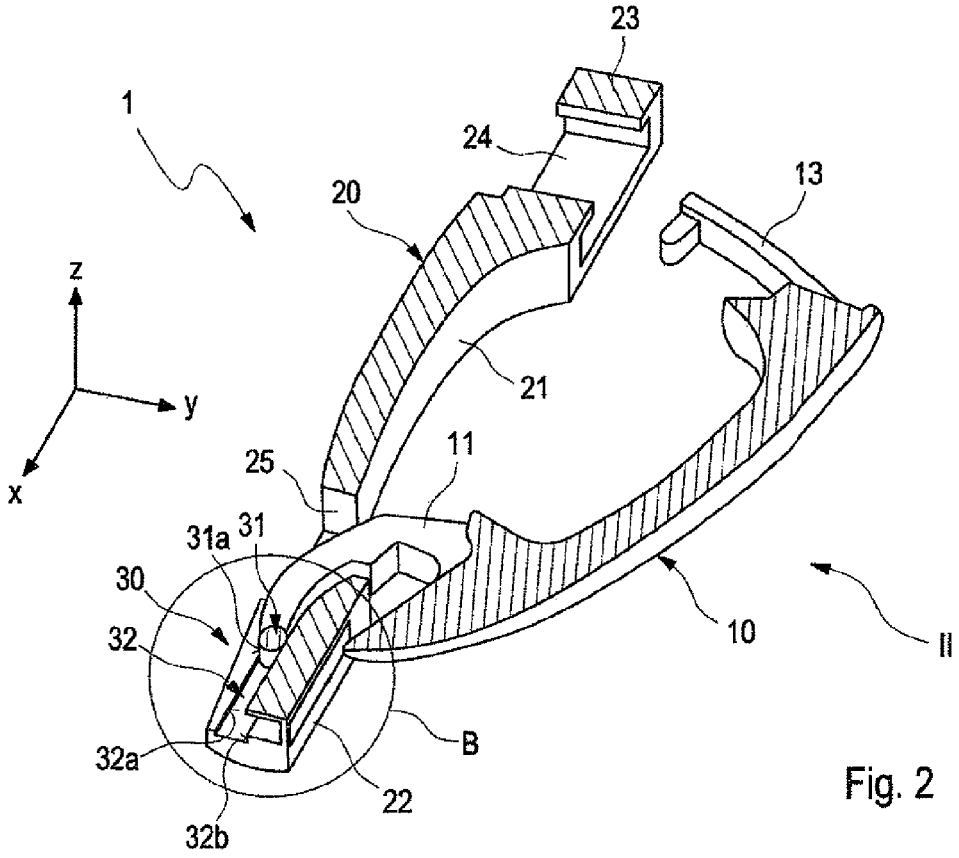

In the partial cross-sectional view of FIG. 2 along section A-A of FIG. 1, the door handle 10 is in a swivel-out position II, i.e. in its extended position.

According to FIG. 2, the bearing bracket 20 composed of a plastic material includes a central part 21 shaped like a recessed grip, which has at one end a bearing portion 22 and at the opposite end an end portion 23. The bearing portion 22 forms in conjunction with a pivot pin 31, which is connected to the door handle 10, a hinge assembly 30.

This hinge assembly 30 includes in addition to the pivot pin 31 a guide groove 32 which is formed in the bearing portion 22 of the bearing bracket 20 and receives the pivot pin 31 so that the pivot pin 31 forms a pivot axis of the door handle 10 for pivoting from its resting position I (see FIG. 1) into its swivel-out position II and vice versa.

The door handle 10 which is manufactured also from plastic is formed at one end with a bearing arm 11 and at the other end with a draw hook 13. The support arm 11 carries at the end the pivot pin 31 oriented in the z-direction of the vehicle, wherein the bearing arm 11 is guided through a bearing opening 25 of the bearing bracket 20. The draw hook 13 engages through an operational opening 24 in the end portion 23 of the bearing bracket 20 and is connected to an unillustrated drawbar.

The circumferential surface 31*a* of the pivot pin 31 is operatively connected as a contour surface with the two parallel and flat contour surfaces 32*a* and 32*b* forming the guide groove 32, so that the pivot pin 31 is guided and rotatably supported by these two contour surfaces 32*a* and 32*b*.

The cross-section of the pivot pin 31 has an elliptical shape with a minor diameter d1 and a major diameter d2. This elliptical shape of the pivot pin 31 is oriented such that it generates in the swivel-out position II of the door handle 10 according to the diagram of FIGS. 2 and 2*a* a clearance fit by way of the contour surface 31*a* of the pivot pin 31 and the contour of surfaces 32*a* and 32*b* of the guide groove 32 and that this clearance fit transitions, when the door handle 10 is pivoted into its resting position I, via a transitional fit into an interference fit, as shown schematically in FIG. 3. During this movement, the pivot pin 31 rotates between the two contour surfaces 32*a* and 32*b* such that the length of the chord S1 connecting the contact regions K1*a* and K1*b* of the contour surface 31*a* of the pivot pin 31 and the contact portions 32*a* and 32*b* in the swivel-out position II increases up to the length of the chord S2 between the contact regions K2*a* and K2*b* of the contour surface 31*a* of the pivot pin 31 and the contour of surfaces 32*a* and 32*b* of the guide groove 32.

The chord is S1 between the contact regions K1*a* and K1*b* is here selected so that a clearance fit is realized in conjunction with the distance a between the two contour surfaces 32*a* and 32*a*, while the length of the chord S2 between the contact regions K2*a* and K2*b* has a larger value, thus forming in conjunction with the distance a between the two contour surfaces 32*a* and 32*b* an interference fit in the resting position I of the door handle 10. Thus, the length of the chord S between the contact regions of the contour surface 31*a* of the pivot pin 31 and contour surfaces 32*a* and 32*b* of the guide groove 32 continuously increases during the pivoting movement of the door handle 10 from the swivel-out position II into its resting position I, i.e. from a length of the chord S1 to the length of the chord S2.

The value of the length of the chord S1 is hereby in the range of the value of the minor diameter d1 of the elliptical shape of the pivot pin cross-section, whereas the value of the length of the chord S2 is in the range of the value of the major diameter d2.

Figure 2A:
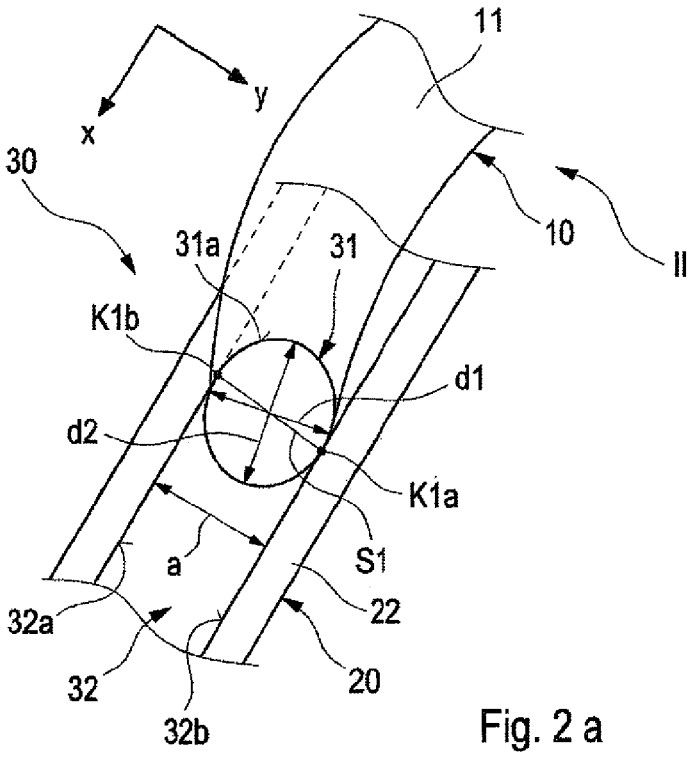
Figure 3:
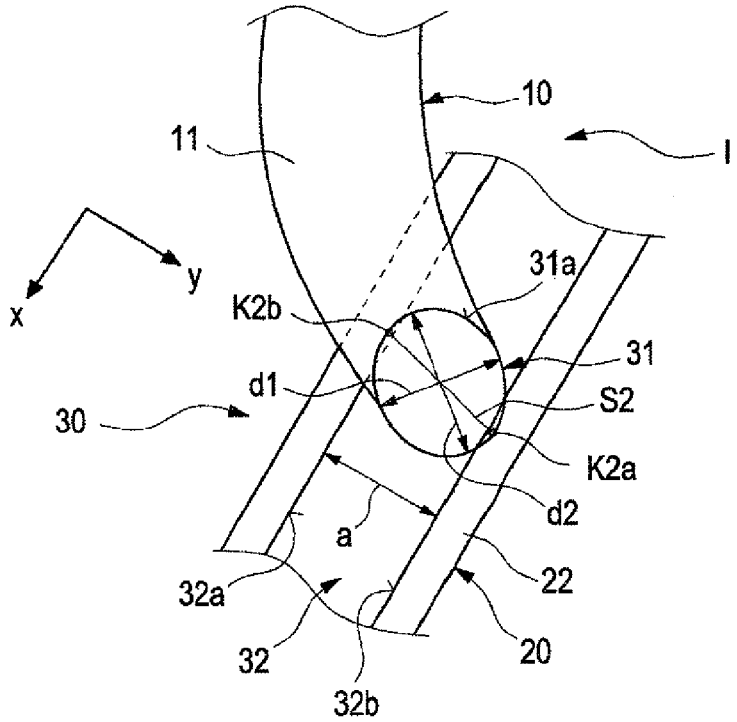
Figure 4:
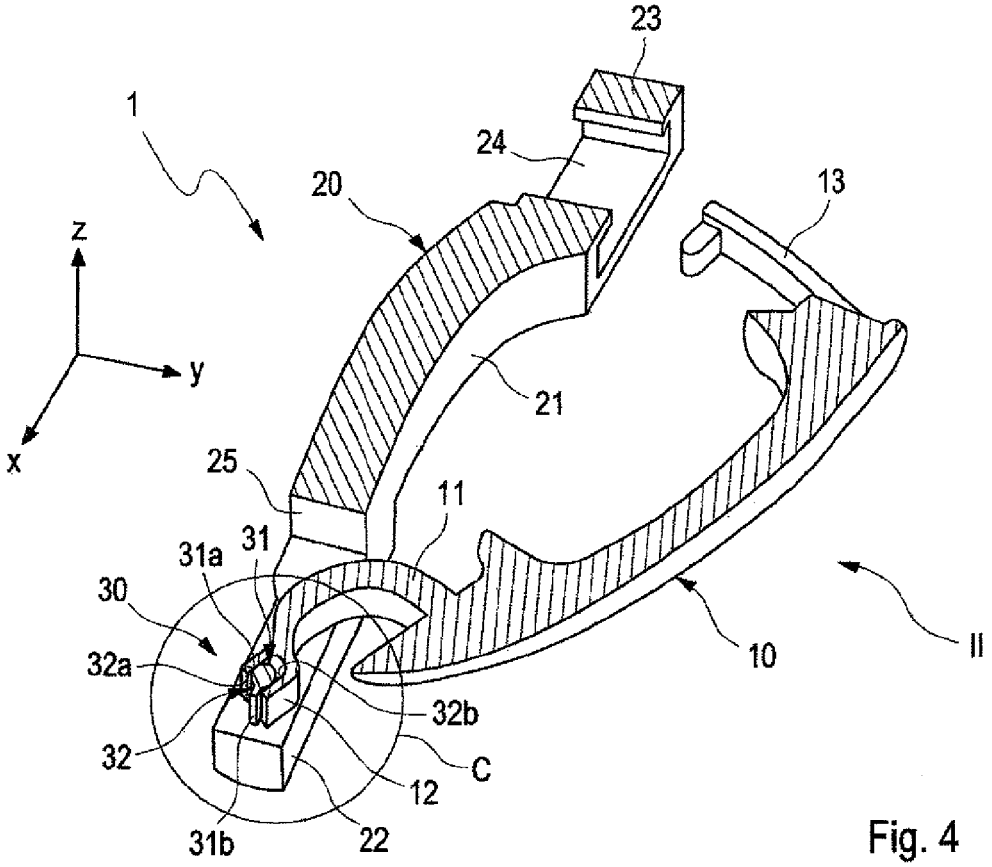
Figure 4A:
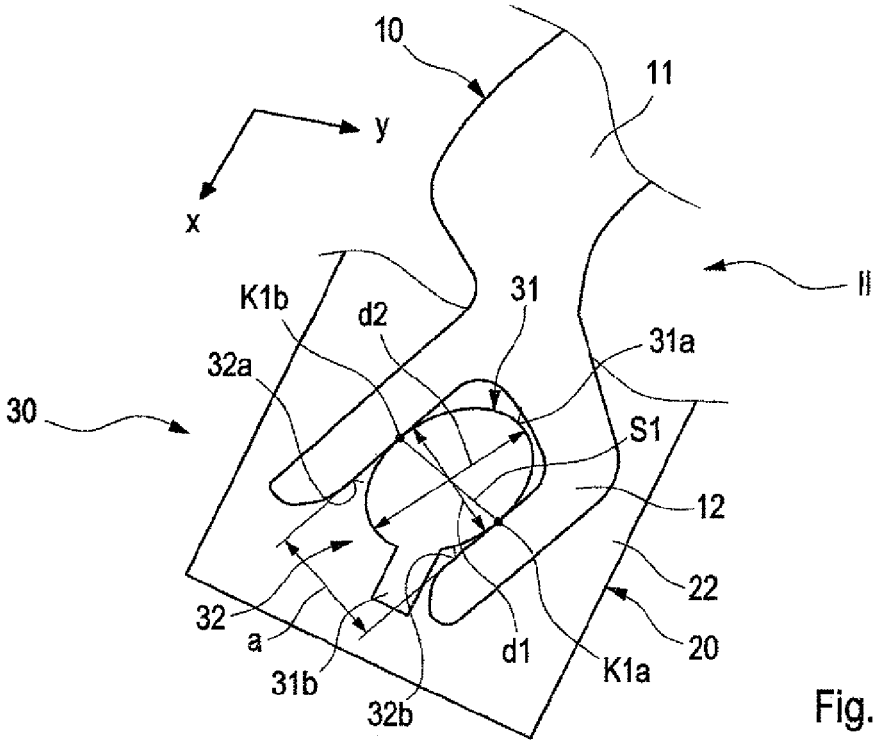
Figure 5:
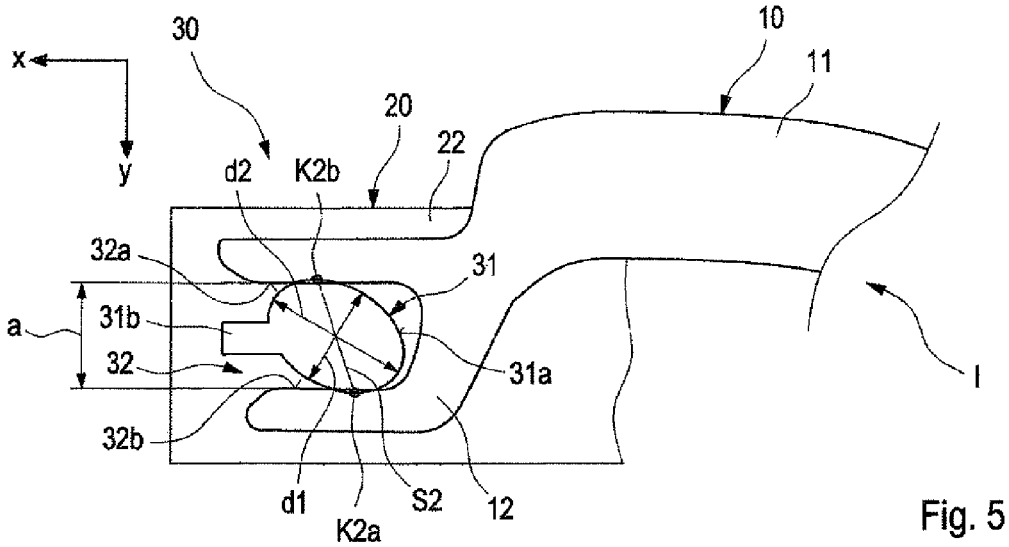

The exterior door handle arrangement 1 according to FIGS. 4, 4*a* and 5 differs from that according to FIGS. 2, 2*a* and 3 only by the hinge assembly 30, while the other components are identical.

This hinge assembly 30 according to FIGS. 4, 4*a* and 5 also includes a pivot pin 31 with an elliptical cross-section arranged in the region of the bearing portion 22, at which a ridge 31*b* is formed on the side facing away from the door handle. The associated guide groove 32 with parallel and flat contour surfaces 32*a* and 32*b* is formed of a bearing fork 12, which supports the end of the bearing arm 11 of the door handle 10.

The elliptical shape of the cross-section of the pivot pin 31 has also a minor diameter d1 and a major diameter d2, wherein in this exemplary embodiment the pivot pin 31 and the guide groove 32 are also oriented with respect to one another such that the outer surface 31*a* as a contour surface of the pivot pin 31 in conjunction with the contour surfaces 32*a* and 32*b* of the guide groove 32 form a clearance fit when the door handle is in the swivel-out position II shown in FIGS. 4 and 4*a*. When the door handle 10 is pivoted back from this swivel-out position II into its resting position I, this clearance fit merges transitions via a transitional fit into an interference fit.

To achieve this effect, the pivot pin 31 is disposed with its elliptical cross-sectional shape on the bearing portion 22 of the bearing bracket 20 in such a way that the direction of the major diameter d2 forms an acute angle to the x-direction of the vehicle. In this way, in the swivel-out position II of the door handle 10, the chord S1 connecting the contact regions K1*a* and K1*b* of the contour surface 31*a* of the pivot pin 31 with the contour surfaces 32*a* and 32*b* has a value which realizes a clearance fit in conjunction with the distance a of the two contour surfaces 32*a* and 32*b* of the bearing fork 12. The length of this chord S1 increases continuously to the length of the chord S2 between the contact regions K2*a* and K2*b* when the door handle 10 is pivoted back into its resting position I, wherein the length of this chord S2 has a value which forms an interference fit in conjunction with the two contour surfaces 32*a* and 32*b* of the guide groove 32. In this resting position I, the two contour surfaces 32*a* and 32*b* extend in the x-direction of the vehicle.

Figure 6:
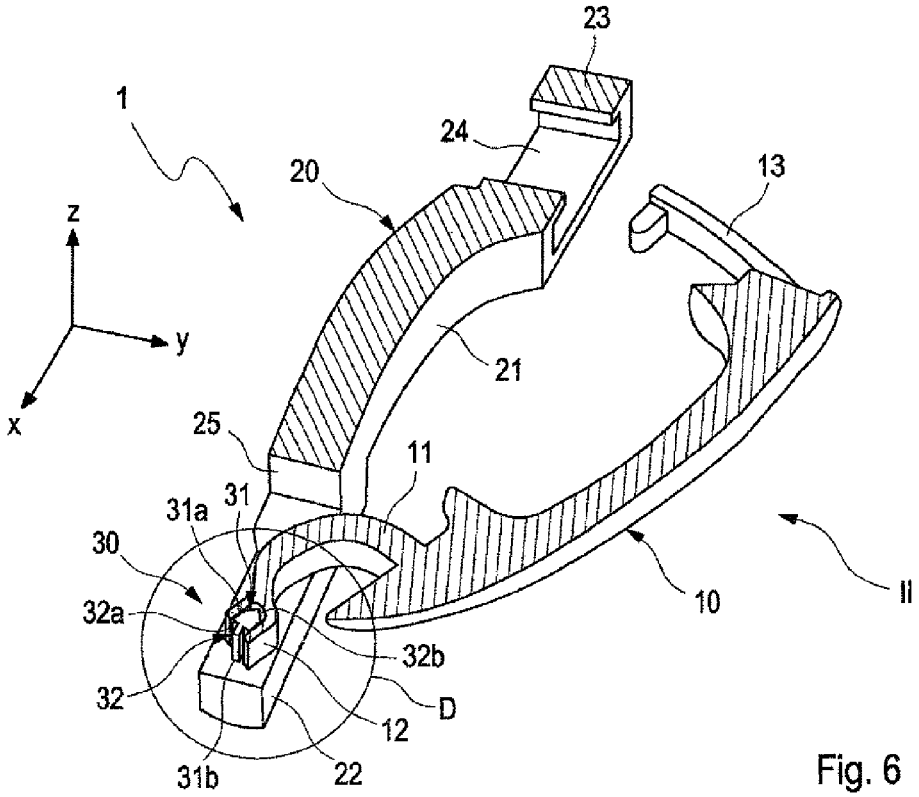
Figure 6A:
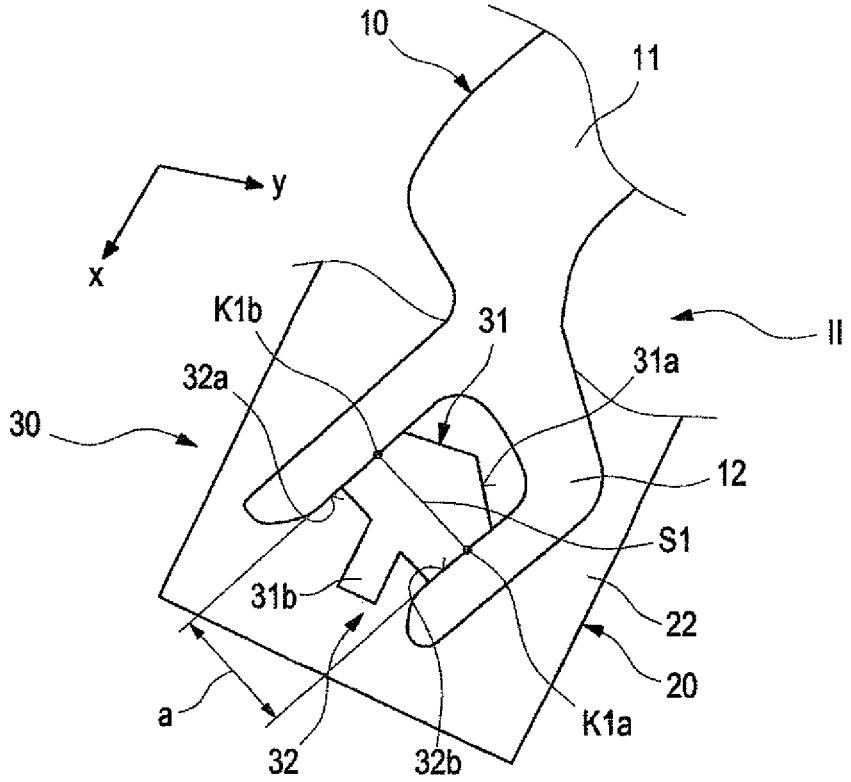
Figure 7:
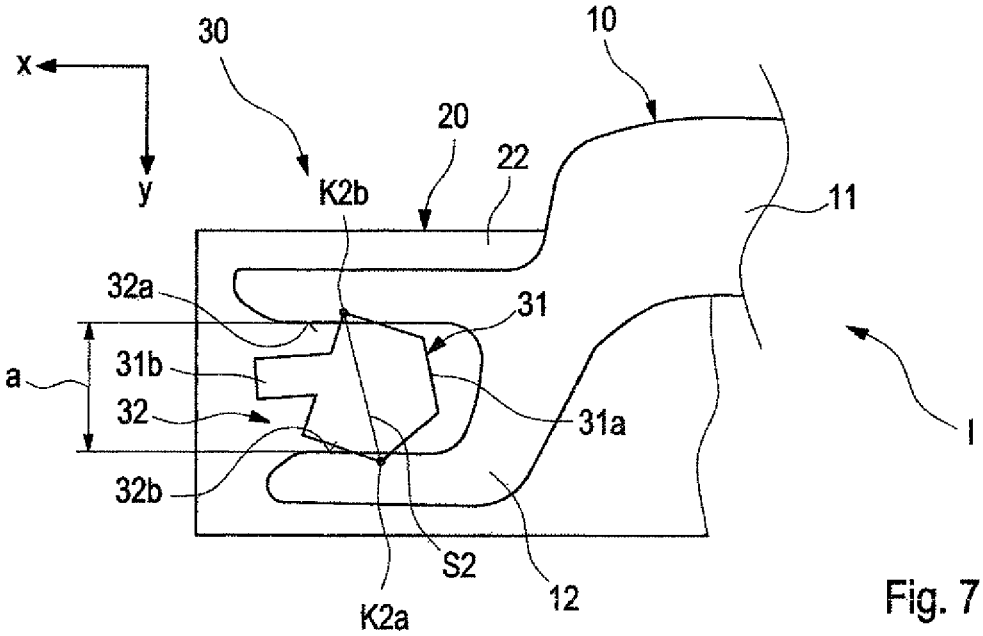

The last exemplary embodiment according to FIGS. 6, 6*a* and 7 also differs from the previous embodiments only by the joint assembly 30.

The pivot pin 31 of this hinge assembly according to the FIGS. 6, 6*a* and 7 is arranged on the bearing portion 22 of the bearing bracket 20 of the exterior door handle arrangement 1 and has a polygonal, i.e. a five-cornered cross-section, wherein a ridge 31*b* is formed on the side facing away from the door handle. The door handle 10 has a support arm 11 with an end-side bearing bracket 12, with encompasses the pivot pin 31 as a guide groove 32 with two parallel and flat contour surfaces 32*a* and 32*b*.

The outer surface 31*a* of the pivot pin 31 forms a clearance fit in conjunction with the contour surfaces 32*a* and 32*b* of the bearing fork 12 in the swivel-out position II of the door handle 10 illustrated in FIGS. 6 and 6*a*, which transitions via a transitional fit into an interference fit when the door handle 10 is pivoted back into its resting position I shown in FIG. 7.

To achieve this effect, the contour of surfaces 32*a* and 32*b* of the bearing fork 12 are oriented such that the chord S1 connecting the contact regions K2*a* and K2*b* of the contour surfaces 31*a*, 32*a* and 32*b* in the resting position I of the door handle 10 has a length that produces a clearance fit in conjunction with the distance a between the two contour surfaces 32*a* and 32*b* of the bearing fork 12. When the door handle 10 is pivoted back into the resting position I shown in FIG. 7, the length of this chord increases up to the chord S2 between the contact regions K2*a* and K2*b* that corresponds to the distance between two opposite corners of the pentagonal cross-sectional shape of the pivot pin 31. In this resting position I, the contour surfaces 32*a* and 32*b* are oriented at an acute angle with respect to the x-direction of the vehicle and caused tilting of the pivot 31 in the guide groove 32 and thus an interference fit due to the pivoting back from the swivel-out position II.

The invention claimed is:

1. An exterior door handle arrangement for a vehicle door of a vehicle, comprising:

a door handle, a bearing bracket, and a hinge assembly comprising a pivot pin having an outer surface forming a first contour surface and a guide groove having second contour surfaces, with the guide groove operatively connected with the pivot pin and accommodating the pivot pin for pivotable connection of the door handle with the bearing bracket, wherein the pivot pin in the guide groove forms a pivot axis of the door handle when the door handle is pivoted from a resting position into a swivel-out position and the pivot pin has an elliptical cross-section with a minor diameter and a major diameter, wherein the first contour surface is operatively connected with the second contour surfaces of the guide groove, wherein the first contour surface of the pivot pin and the second contour surfaces of the guide groove are formed with a fit such that a clearance fit is produced in the swivel-out position of the door handle, with the clearance fit transitioning via a transitional fit into an interference fit, when the door handle is pivoted from the swivel-out position into a resting position.

2. The exterior door handle arrangement of claim 1, wherein for generating the clearance fit, the transitional fit and the interference fit, the pivot pin is arranged in a way that [when the door handle is pivoted from cross-section of the pivot pin increases between contact regions of the first and second contour surfaces.

3. The exterior door handle arrangement of claim 1, wherein the parallel contour surfaces of the guide groove are flat and extend in a longitudinal direction of the vehicle (x-direction of the vehicle), when the door handle is in its resting position.

4. The exterior door handle arrangement of claim 1, wherein the pivot pin is connected to the door handle.

5. The exterior door handle arrangement of claim 1, wherein the pivot pin is connected to the bearing bracket and an end of the door handle comprises a bearing fork forming the guide groove with flat contour surfaces.

6. The exterior door handle arrangement of claim 1, wherein the pivot pin is formed with a polygonal cross-section, with the first contour surface of the pivot pin being operatively connected with the parallel contour surfaces of the guide groove.

7. The exterior door handle arrangement of claim 6, wherein the pivot pin is arranged in a way that [when the door handle is pivoted from the swivel-out position into the resting position a length of a chord of the polygonal cross-section of the pivot pin increases between contact regions of the first and second contour surfaces starting from a chord length of the clearance fit to a chord length of the interference fit.

8. The exterior door handle arrangement of claim 7, wherein the pivot pin is connected to the bearing bracket and on one end of the door handle a bearing fork is located forming the guide groove with flat contour surfaces, said bearing fork and said pivot pin being oriented with respect to one another in a way that the chord length between the contact regions of the first and second contour surfaces producing the interference fit is established in the resting position of the door handle.

9. The exterior door handle arrangement of claim 8, wherein the pivot pin and the second contour surfaces are oriented with respect to each other in a way that in the swivel-out position of the door handle the second contour surfaces of the bearing fork extend in a longitudinal direction (x-direction) of the vehicle and the chord generating the clearance fit is established between the contact regions of the first and second contour surfaces.

* * * * *